US007124693B2

(12) United States Patent
Lucas

(10) Patent No.: US 7,124,693 B2
(45) Date of Patent: Oct. 24, 2006

(54) RAILWAY CAR OUTLET GATE ASSEMBLY

(75) Inventor: Anthony L. Lucas, Little River, KS (US)

(73) Assignee: Aero Transportation Products, Inc., Independence, MO (US)

( * ) Notice: Subject to any disclaimer, the term of this patent is extended or adjusted under 35 U.S.C. 154(b) by 188 days.

(21) Appl. No.: 10/417,744

(22) Filed: Apr. 17, 2003

(65) Prior Publication Data

US 2003/0192452 A1 Oct. 16, 2003

Related U.S. Application Data

(60) Division of application No. 10/073,449, filed on Feb. 11, 2002, now Pat. No. 6,571,718, which is a division of application No. 09/718,913, filed on Nov. 22, 2000, now abandoned, which is a continuation-in-part of application No. 09/166,675, filed on Oct. 5, 1998, now Pat. No. 6,286,437.

(51) Int. Cl.
*B61D 7/22* (2006.01)
*B61D 7/20* (2006.01)

(52) U.S. Cl. ..... 105/282.2; 105/282.1; 105/282.3

(58) Field of Classification Search ..... 105/282.3, 105/238.1, 247, 280, 288, 282.1, 282.2, 286, 105/289, 290, 294, 305; 222/542, 559, 561
See application file for complete search history.

(56) References Cited

U.S. PATENT DOCUMENTS

| | | | | |
|---|---|---|---|---|
| 2,167,364 | A | 7/1939 | Johnson | 105/247 |
| 2,186,700 | A | 1/1940 | Johnson | 105/243 |
| 2,751,860 | A | 6/1956 | Dath | 105/282 |
| 2,751,861 | A | 6/1956 | Withall | 105/282 |
| 2,751,862 | A | 6/1956 | Dorey | 105/282 |
| 2,853,960 | A | 9/1958 | Corrigan | 105/423 |
| 2,898,871 | A | 8/1959 | Dath | 105/253 |
| 2,914,000 | A | 11/1959 | Mulcahy | 105/250 |
| 2,926,963 | A | 3/1960 | Dorey | 302/52 |
| 2,950,144 | A | 8/1960 | Dorey | 302/52 |
| 2,962,325 | A | 11/1960 | Dorey | 302/52 |
| 2,969,083 | A | 1/1961 | Joyce | 137/269 |
| 3,020,093 | A | 2/1962 | Dorey | 302/52 |
| 3,085,517 | A | 4/1963 | Smith | 105/282 |
| 3,138,117 | A | 6/1964 | Dorey | 105/282 |
| 3,174,807 | A | 3/1965 | Adler | 302/52 |
| 3,192,874 | A | 7/1965 | Dorey | 105/247 |
| RE26,093 | E | 10/1966 | Ingram | 105/253 |
| 3,348,501 | A | 10/1967 | Stevens et al. | 105/248 |
| 3,360,302 | A | 12/1967 | Bagguley | 302/52 |

(Continued)

OTHER PUBLICATIONS

Keystone Drawings SE-6286—EXHIBIT A, Dec. 16, 1980.*

(Continued)

*Primary Examiner*—Mark T. Le
(74) *Attorney, Agent, or Firm*—Chase Law Firm, L.C.

(57) ABSTRACT

An outlet gate assembly has upper and lower gate assemblies with independent drive mechanisms to open and close the gates. The drive mechanisms may be rack and pinion drives. The racks for the lower gate do not enter the gate cavity. The outlet gate assembly can be used for vacuum, gravity or pneumatic sled discharge. The vacuum openings are offset from the center plane of the discharge area to allow free flow of lading. The lower gate assembly includes surfaces that cover and protect the lowermost horizontal surfaces of the assembly when the lower gate assembly is closed. Thus, no separate mud plate is needed. The outlet gate assembly includes seals made of an ultra high molecular weight polymer.

4 Claims, 5 Drawing Sheets

U.S. PATENT DOCUMENTS

| | | | | | |
|---|---|---|---|---|---|
| 3,373,884 | A | | 3/1968 | Dorey | 214/83.18 |
| 3,393,017 | A | | 7/1968 | Smith | 302/52 |
| 3,446,538 | A | | 5/1969 | Danielson | 302/52 |
| 3,486,241 | A | | 12/1969 | Coyle et al. | 34/22 |
| 3,532,062 | A | * | 10/1970 | Pulcrano | 105/282.1 |
| 3,539,224 | A | | 11/1970 | Beezhold | 302/52 |
| 3,578,815 | A | | 5/1971 | Mundinger et al. | 302/52 |
| 3,639,007 | A | | 2/1972 | Dare et al. | |
| 3,650,567 | A | | 3/1972 | Danielson | 302/52 |
| 3,742,865 | A | * | 7/1973 | Adler | 105/282.1 |
| 3,888,188 | A | | 6/1975 | Fuller | 105/282 R |
| 4,360,295 | A | | 11/1982 | Anderson | 406/75 |
| 4,428,504 | A | | 1/1984 | Bassett et al. | |
| 4,617,868 | A | | 10/1986 | Wahlstrom et al. | 105/282 A |
| 5,507,235 | A | | 4/1996 | Dugge et al. | 105/282.3 |
| 6,123,030 | A | * | 9/2000 | Dohr et al. | 105/282.2 |

OTHER PUBLICATIONS

Keystone Railway Equipment Company, Drawing SE-6286, dated Nov. 19, 1996, Exhibit A.

Keystone Railway Equipment Company, Drawing SE-17071, dated Nov. 20, 1997, Exhibit B.

Keystone Railway Equipment Company, Drawing SE-16236, dated Feb. 9, 1995, Exhibit C.

Keystone Railway Equipment Company, Drawing SE-16231, dated May 6, 1995, Exhibit D.

Keystone Railway Equipment Company, Drawing SE-17550, dated Feb. 25, 1997, Exhibit E.

* cited by examiner

RAILWAY CAR OUTLET GATE ASSEMBLY

This is a divisional application Ser. No. 10/073,449, of U.S. Pat. No. 6,571,718, entitled RAILWAY CAR OUTLET GATE ASSEMBLY, which is a divisional of U. S. patent application Ser. No. 09/718,913, filed Nov. 22, 2000 now abandoned and entitled RAILWAY CAR OUTLET GATE ASSEMBLY (application abandoned), which is a continuation-in-part of Ser. No. 09/166,675, U.S. Pat. No. 6,286,437 entitled RAILWAY CAR OUTLET GATE ASSEMBLY.

BACKGROUND OF THE INVENTION

1. Field of the Invention

The present invention relates to outlet gate assemblies for railway hopper cars of the type allowing gravity, vacuum and pneumatic sled discharge of the bulk lading.

2. Description of the Prior Art

Hopper-type railway cars are used to transport lading which is discharged through outlet gate assemblies mounted at the bottoms of the cars. Bulk lading transported by hopper cars include finely divided materials such as sugar, flour, wheat, potash and cement. The filled hopper cars are delivered to shippers' terminals for unloading.

Conventional methods used to unload hopper cars include gravity discharge, vacuum discharge and pneumatic sled discharge of lading. During gravity discharge, lading falls by gravity through a discharge opening in an outlet gate assembly. During vacuum discharge, lading falls down from the car through an outlet gate and into a closed discharge chute. A vacuum hose is connected to the discharge chute and vacuum is applied to the hose. Air drawn into the discharge chute carries the lading along the discharge chute and into the vacuum hose. During pneumatic sled discharge, a pneumatic sled is attached to the bottom of the discharge opening. The pneumatic sled includes screw-type conveyors for discharging lading from the hopper car. Compressed air is blown into the discharge opening to pressurize the inside of the hopper car and separate compacted lading. The lading falls through the discharge opening and into the screw conveyors for removal.

Each unloading method requires its own specialized equipment to unload a hopper car. Nonetheless, a shipper may require one unloading method over another. Typically, a shipper's terminal can accommodate only one method for unloading a hopper car. For instance, one shipper may gravity discharge sugar from a hopper car while another shipper may vacuum discharge sugar from a hopper car. As a result, shipper requirements dictate the type of hopper car used to transport lading to discharge terminals.

To provide flexibility to the railroads, conventional outlet gate assemblies permit gravity discharge, vacuum discharge or pneumatic sled discharge. The same hopper car can accommodate all shippers without regard to the particular discharge method required. This flexibility gives the railroads increased freedom in scheduling hopper cars, particularly for seasonal loads, and reduces operating costs.

The prior art multi-discharge outlet gate assemblies include a rectangular frame that defines a rectangular discharge opening at the bottom of the assembly. A pair of opposed vacuum nozzles are mounted on the frame and open into the discharge opening. The opposed vacuum nozzles are centered on the transverse center plane of the discharge opening. Openings for the vacuum nozzles in the frame are covered by nozzle baffles. Upper and lower door slides are mounted in the frame. Each door slide is supported on its edges by the frame and extends through a slot in the frame.

Slot seals prevent exposure of lading to outside contaminants. The gates are movable between closed and opened positions to open and close the upper and lower ends of the assembly.

In the prior art, an opening and closing drive shifts the upper gate between open and closed positions. The drive includes fixed racks and an operating shaft. The operating shaft carries pinions which engage the racks. The operating shaft is rotated in an appropriate direction to move the upper gate and the operating shaft in a desired direction.

In the prior art, a locking mechanism allows the upper gate to be locked to the lower gate so that both gates move together. When the gates are locked together, rotation of the operating shaft simultaneously moves both the upper and lower gates between opened and closed positions. When the gates are unlocked from one another, rotation of the operating shaft moves the upper gate only and the lower gate is stationary.

During gravity or pneumatic sled discharge of lading in the prior art, the door locking mechanism locks the upper and lower gates together. The operating shaft is rotated to move the upper and lower gates simultaneously from the closed position to the open position. Lading falls down through the gate assembly.

During vacuum discharge of the hopper car in the prior art, vacuum hoses are attached to the vacuum nozzles. The door locking mechanism is unlocked. The operating shaft is rotated to open the upper gate only. The lower gate remains closed. Lading falls down into the frame but cannot exit through the bottom of the assembly. Vacuum draws air and lading into the vacuum hoses.

Some prior art outlet gates include separate mud plates that are mounted to the frame below the lower discharge gate. These mud plates cover and protect structures above them, and are removable for gravity and pneumatic sled discharge.

SUMMARY OF THE INVENTION

In one aspect, the present invention provides an outlet gate assembly adapted to be mounted on a hopper-type container. The outlet gate assembly comprises a frame, an upper gate assembly and a lower gate assembly. The frame defines a generally rectangular discharge opening. The upper gate assembly is mounted on the frame and includes an upper plate having top and bottom surfaces and an upper rack that is mounted on the bottom surface of the plate. The lower gate assembly is also mounted on the frame and includes a lower plate having top and bottom surfaces and a rack mounted on the top surface of the plate. The outlet gate assembly also includes an upper shaft rotatably mounted on the frame and an upper pinion on the upper shaft and engaging the upper rack. The outlet gate assembly includes a lower shaft rotatably mounted on the frame and a lower pinion on the lower shaft and engaging the lower rack. The upper plate is movable between open and closed positions by rotating the upper shaft. The lower plate is movable between open and closed positions by rotating the lower shaft. The outlet gate assembly has a cavity below the bottom surface of the upper plate of the upper gate assembly and above at least part of the top surface of the lower gate assembly when the upper and lower plates are in the closed positions. At least part of the upper rack is within the cavity when the upper plate is in the closed position. All of the lower rack is outside of the cavity when the lower plate is in the closed position and when the lower plate is in the open position.

In another aspect, the present invention provides an outlet gate assembly adapted to be mounted on a hopper-type container. The assembly comprises a frame defining a generally rectangular discharge opening. An upper gate assembly is mounted on the frame at the discharge opening. The upper gate assembly includes an upper plate having top and bottom surfaces and a rack. A lower gate assembly is also mounted on the frame. The lower gate assembly includes a lower plate having top and bottom surfaces. An upper shaft is rotatably mounted on the frame. An upper pinion is on the upper shaft and engages the rack of the upper gate assembly. The upper plate is movable between open and closed positions by rotating the upper shaft. The lower plate is movable between open and closed positions. The outlet gate assembly has a cavity below the bottom surface of the upper plate of the upper gate assembly and above at least part of the top surface of the lower gate assembly when the upper and lower plates are in the closed positions. A vacuum discharge opening is between the level of the upper plate and the level of the lower plate and is positioned to provide an outlet from the cavity. The rectangular discharge opening of the frame has a transverse center plane that intersects the rack of the upper gate assembly when the upper plate is in the closed position. The vacuum discharge is offset from the transverse center plane of the rectangular discharge opening of the frame.

In another aspect, the present invention provides an outlet gate assembly adapted to be mounted on a hopper-type container. The assembly comprises a frame defining a generally rectangular discharge opening. The frame has a pair of frame side members and a transverse member extending between the side members. An upper gate assembly is mounted on the frame. The upper gate assembly includes an upper plate having top and bottom surfaces. A lower gate assembly is mounted on the frame. The lower gate assembly includes a lower plate having top and bottom surfaces. The upper plate is movable in a longitudinal direction between open and closed positions. The lower plate is movable in a longitudinal direction between open and closed positions. The outlet gate assembly has a cavity below the bottom surface of the upper plate of the upper gate assembly and above at least part of the top surface of the lower gate assembly when the upper and lower plates are in the closed positions. There is a seal between the transverse member of the frame and the bottom surface of the upper plate. The seal extends transversely across at least part of the upper plate. There is an ultra high molecular weight seal between the transverse member of the frame and the top surface of the lower plate. The ultra high molecular weight seal extends transversely across at least part of the lower plate. An ultra high molecular weight seal is between another portion of the frame and the top surface of the lower plate; this ultra high molecular weight seal extends transversely across at least part of the lower plate.

In another aspect, the present invention provides an outlet gate assembly adapted to be mounted on a hopper-type container. The outlet gate assembly comprises a frame defining a generally rectangular discharge opening. The frame has a pair of frame side members and a rear frame member. An upper gate assembly is mounted on the frame and is movable longitudinally between open and closed positions. The upper gate assembly includes an upper plate with a top surface and a bottom surface. A lower gate assembly is also mounted on the frame and is movable longitudinally between open and closed positions. The lower gate assembly includes a lower plate with a top surface and a bottom surface. The outlet gate assembly has a cavity below the bottom surface of the upper plate of the upper gate assembly and above at least part of the top surface of the lower plate of the lower gate assembly when the upper and lower plates are in the closed positions. The frame side members have a plurality of longitudinal horizontal surfaces below the cavity that are exposed when the upper gate assembly and lower gate assembly are in the open position. These longitudinal horizontal surfaces are covered by a portion of the lower gate assembly when the lower gate assembly is in the closed position. The outlet gate assembly includes one horizontal transverse surface below the cavity that is exposed when the upper gate assembly and the lower gate assembly are in the open position and covered by a portion of the lower gate assembly when the lower gate assembly is in the closed position.

BRIEF DESCRIPTION OF THE DRAWINGS

In the accompanying drawings, like reference numbers have been used for like parts, and.

DETAILED DESCRIPTION

Figure 1:
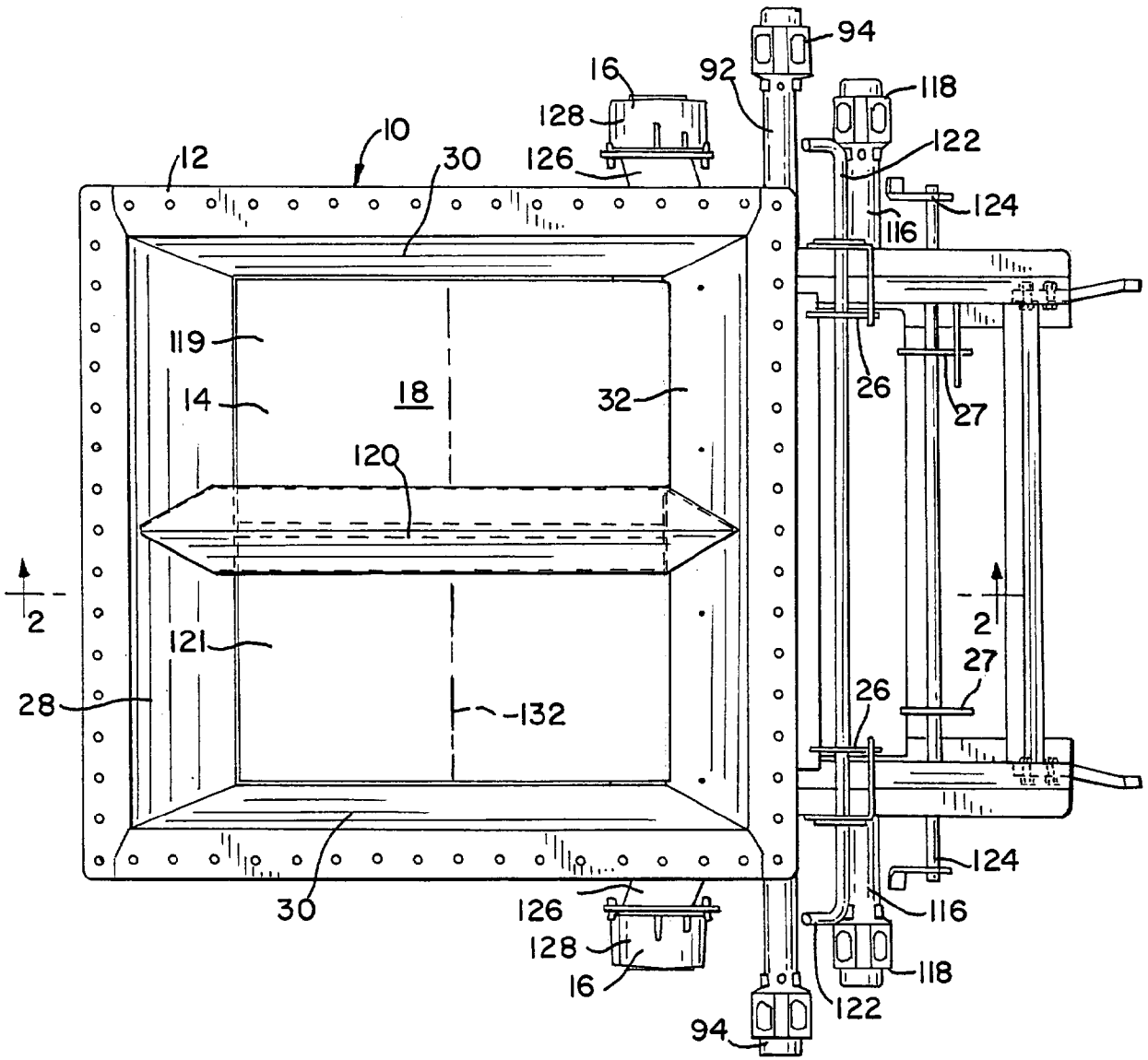
FIG. 1 is a top plan view of an outlet gate assembly incorporating the features of the present invention.

Embodiments of outlet gate assemblies incorporating features of the present invention are illustrated in the accompanying drawings where like reference numbers have been used for like parts. As shown in FIG. 1, the first illustrated outlet gate assembly 10 includes a rectangular frame 12 that includes a discharge chute 14. Vacuum nozzle assemblies 16 are mounted on the frame 12 for vacuum discharge of lading from the discharge chute 14.

The frame 12 of the outlet gate assembly 10 may be bolted to a discharge opening at the bottom of a hopper-type railway car (not shown) to control the discharge of lading from the car. The outlet gate assembly 10 may also be bolted to other types of transportable containers, for example, over-the-road hopper-type trailers pulled by tractor trucks.

Figure 9:
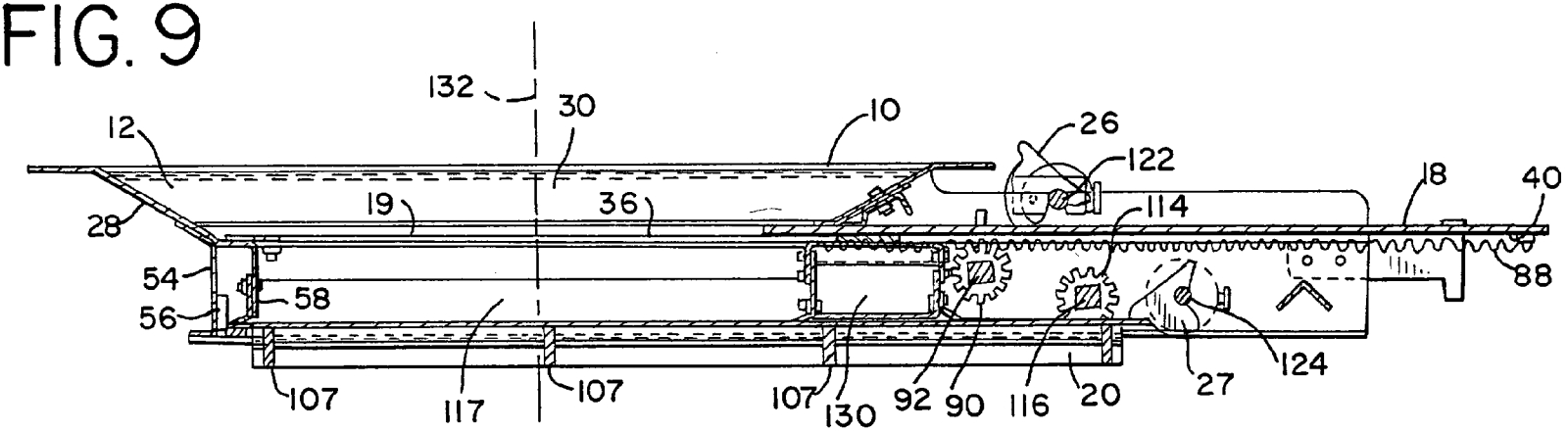
FIG. 9 is a cross-sectional view of the outlet gate assembly of FIG. 1, shown with the upper gate in an open position and the lower gate in a closed position.

As shown in FIGS. 1–2 and 9–10, the outlet gate assembly includes a rectangular upper door or gate 18 that is mounted at the top of the frame 12. As shown in FIG. 9, when the upper gate 18 is opened, the upper gate 18 defines an upper discharge opening 19. The upper gate 18 is movable between a closed position shown in FIG. 2 where it completely closes the upper discharge opening 19 and the open position shown in FIGS. 9 and 10 where the upper gate 18 is moved to the front side of the frame 12 to uncover the upper discharge opening 19.

Figure 10:
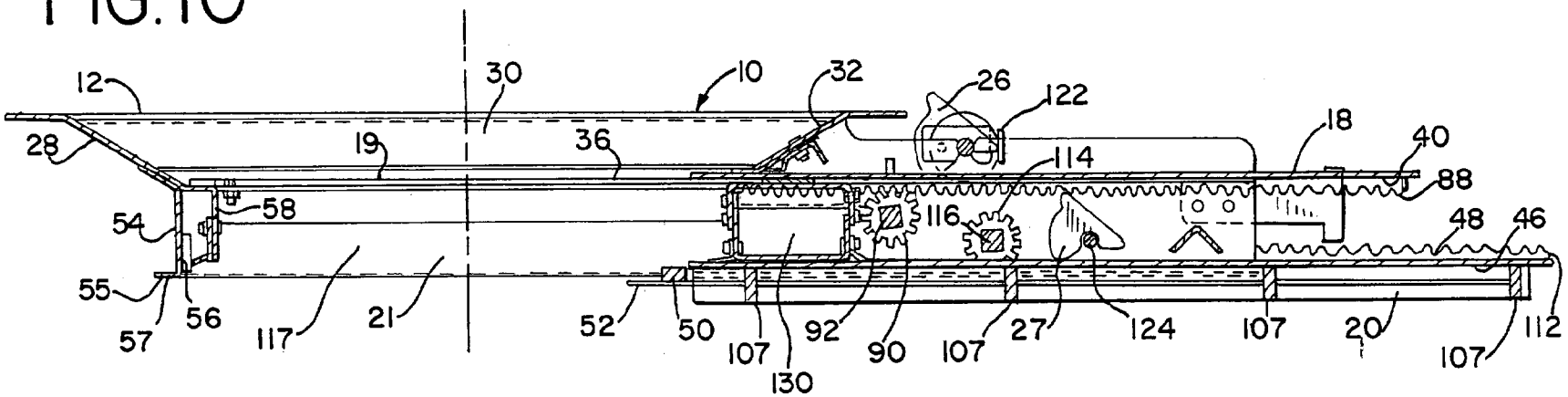
FIG. 10 is a cross-sectional view of the outlet gate assembly of FIG. 1, shown with the upper gate in an open position and the lower gate is a substantially open position; the lower gate may preferably be further opened before lading is discharged.

As shown in FIGS. 1–2 and 9–10, a rectangular lower door or gate 20 assembly is mounted at the lower end of the frame 12. When opened as shown in FIG. 10, the lower gate assembly 20 defines a lower discharge opening 21 that is vertically aligned with the upper discharge opening 19. The lower gate 20 is movable between a closed position shown in FIG. 2 where the lower gate assembly 20 completely closes the lower discharge opening 21, and an open position shown in FIG. 10 where the lower gate assembly 20 is moved to the front side of the frame 12 to uncover the lower discharge opening 21.

Figure 2:
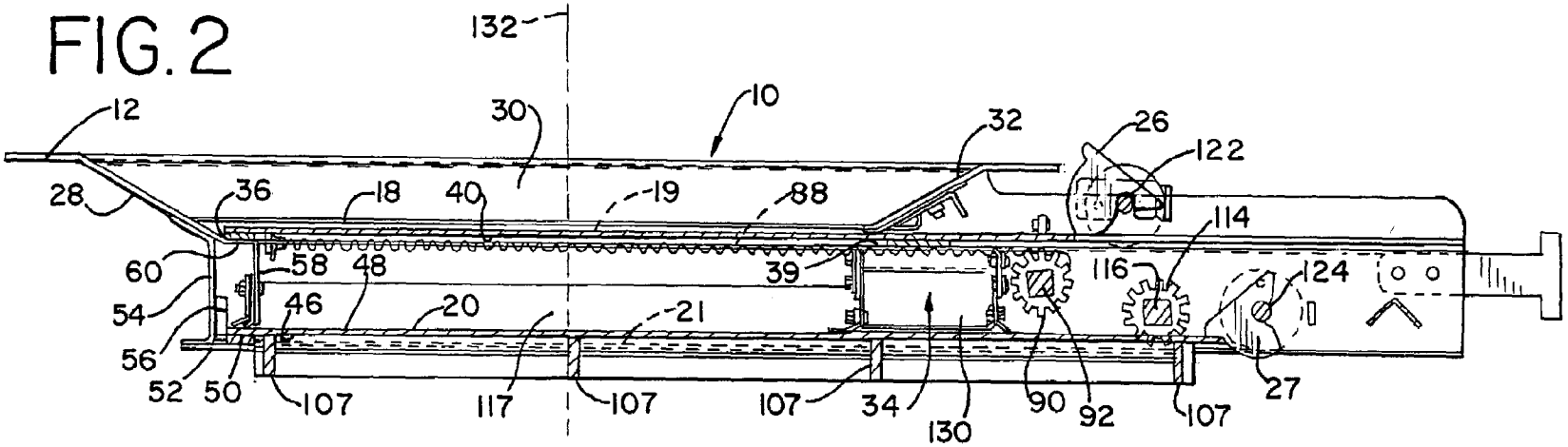
FIG. 2 is a cross-section of the outlet gate assembly of FIG. 1, taken along line 2—2 of FIG. 1, shown with both the upper and lower gate assemblies in a closed position.
Figure 3:
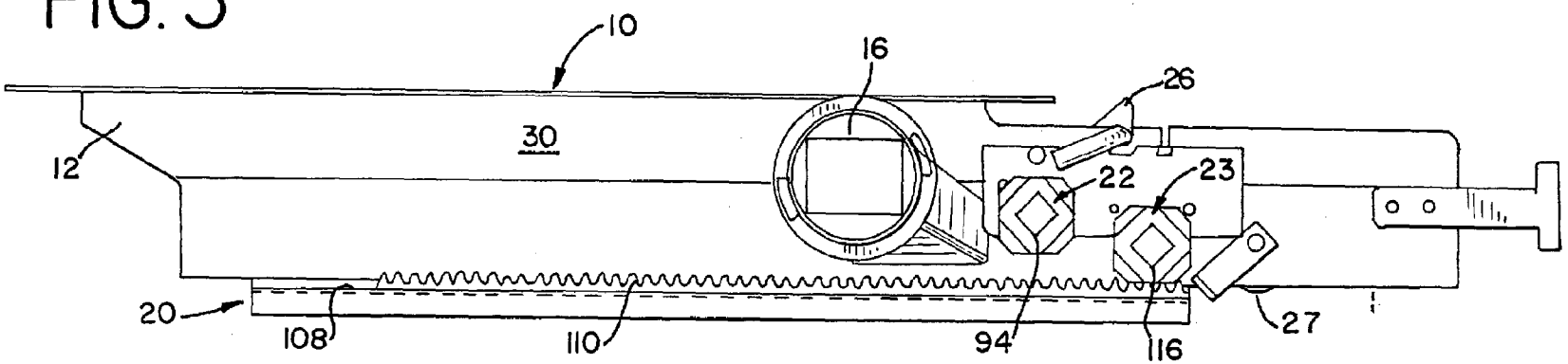
FIG. 3 is a side elevation of the outlet gate assembly of FIG. 1, shown with both the upper and lower gate assemblies in a closed position.

The upper gate 18 is moved between the open and closed positions by an upper gate opening and closing drive 22. An upper gate latch 26 latches the upper gate 18 in the closed position. The lower gate assembly 20 is moved between the open and closed positions by a separate lower gate opening and closing drive 23. A lower gate latch 27 latches the lower gate assembly 20 in the closed position. The upper and lower gate latches 26, 27 preferably have automatic locking and manual unlocking features. As shown in FIGS. 2–3 and 9–10, both latches 26, 27 may be manually rotated from the latched to the unlatched positions, and may automatically rotate from the unlatched to the latched positions. In FIGS. 2 and 9, upper latch 26 is shown in the unlatched position and lower latch 27 is shown in the latched position. When latched, the upper latch 26 would rotate into a position like that shown for lower latch in FIGS. 2 and 9.

The frame 12 includes a rear frame member 28, a pair of side frame members 30, an upper front frame member 32 and a box-shaped lower front frame assembly 34. A rectangular strip slide 36 surrounds the upper discharge opening 19 and is attached to the frame members 28, 30 and to the top surface 39 of the box-shaped lower front frame assembly 34. The slide 36 is juxtaposed between the frame 12 and the bottom surface 40 of the plate 41 of the upper gate 18 to seal and support the bottom surface 40 of the upper gate 18. The plate 41 of the upper gate may move longitudinally over the slide 36 as the upper gate is opened and closed.

Figure 4:
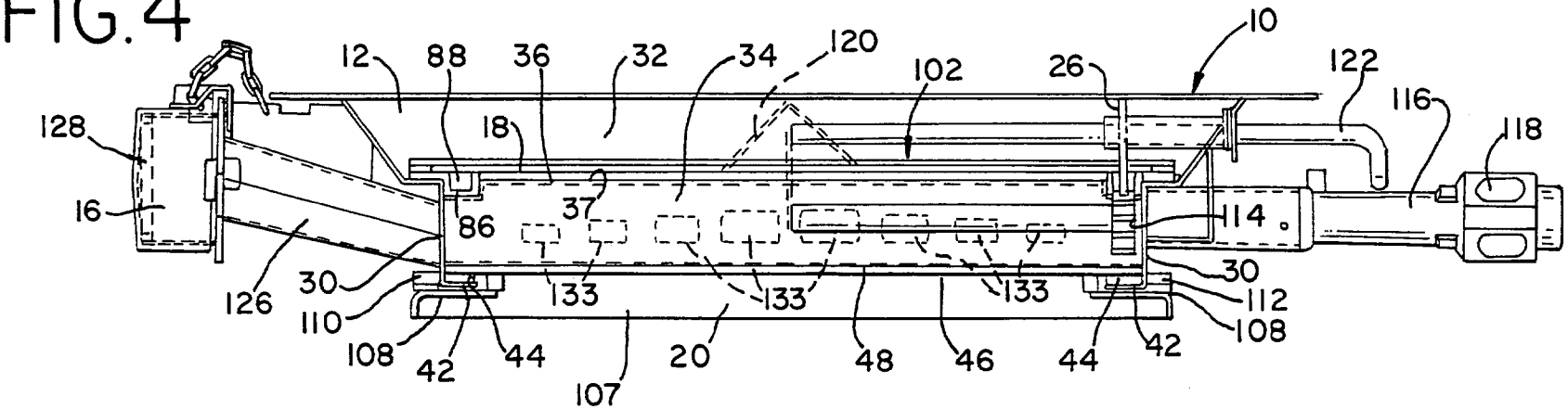
FIG. 4 is a front elevation of the outlet gate assembly of FIG. 1, with parts removed for illustration purposes.
Figure 5:
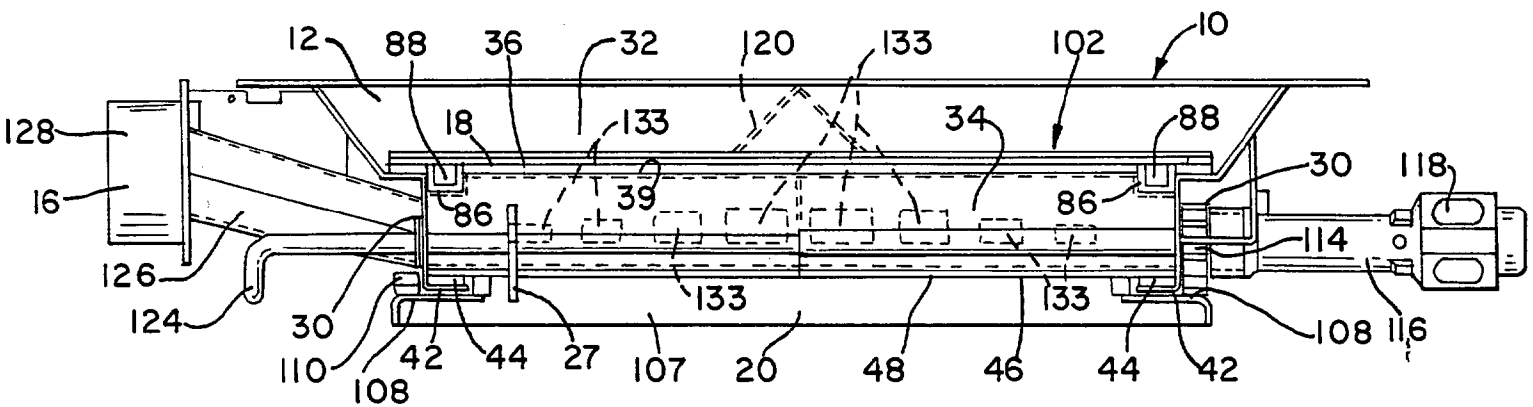
FIG. 5 is a front elevation of the outlet gate assembly of FIG. 1 with parts removed for illustration purposes.

As shown in FIGS. 4–5, each of the side frame members 30 includes a generally horizontal bottom ledge 42 that extends longitudinally from the front to the back of the outlet gate assembly and inwardly toward the longitudinal center plane of the outlet gate assembly. The horizontal bottom ledge 42 has a downward-facing surface 43 and a top surface. The top surface of each bottom ledge 42 supports an elongate strip slide 44. The top surface of each strip slide 44 supports a side edge of the bottom surface 46 of the plate 49 of the lower gate assembly 20. The plate 48 of the lower gate assembly may move over the strip slides 44 as the lower gate is opened and closed.

As shown in FIGS. 2 and 8–10, the rear edge of the plate 48 of the lower gate assembly is connected to a transverse flange or shim 50. The transverse flange or shim 50 is connected to a horizontal transverse plate 52. The horizontal transverse plate 52 comprises a rear flange cover, as will be described below.

The horizontal transverse plate or flange cover 52 is positioned beneath a connecting member 54 on the frame 12. The connecting member 54 is connected to the rear frame member 28. The connecting member 54 has an interior transverse face and a bottom horizontal leg 55. The interior transverse face of the connecting member 54 bears a lower stop member 56, positioned to limit rearward movement of the rear edge of the plate 48 and transverse flange 50 of the lower gate assembly 20. The bottom horizontal leg 55 of the connecting member 54 comprises a flange with a downward-facing surface 57. When the lower gate assembly 20 is closed, as in FIG. 2, the downward-facing surface 57 of the bottom horizontal leg or flange 55 is covered and protected by the rear transverse plate or rear flange cover 52.

Figure 8:
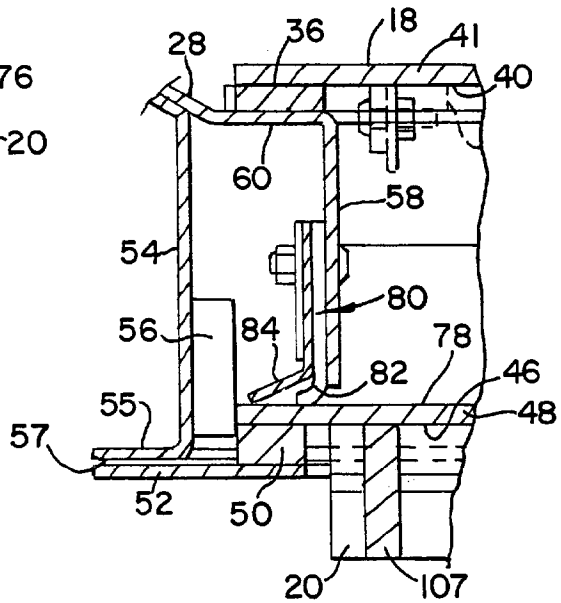
FIG. 8 is an enlarged cross-sectional view of the rear portion of the outlet gate assembly of FIGS. 1–2.

As shown in FIGS. 2 and 8, the rear frame member 28 has a generally vertical bottom section 58 that is positioned forward of the connecting member 54. The generally vertical bottom section 58 is positioned above the level of the plate 48 of the lower gate assembly 20, and below the level of the upper gate 18. The top edge of the generally vertical bottom section 58 is connected to a flat horizontal ledge 60 that supports one length of the upper strip slide 36. The support surface of the flat horizontal ledge 60 is substantially co-planar with the top surface 39 of the lower front frame assembly 34, which supports another length of the upper strip slide.

Figure 6:
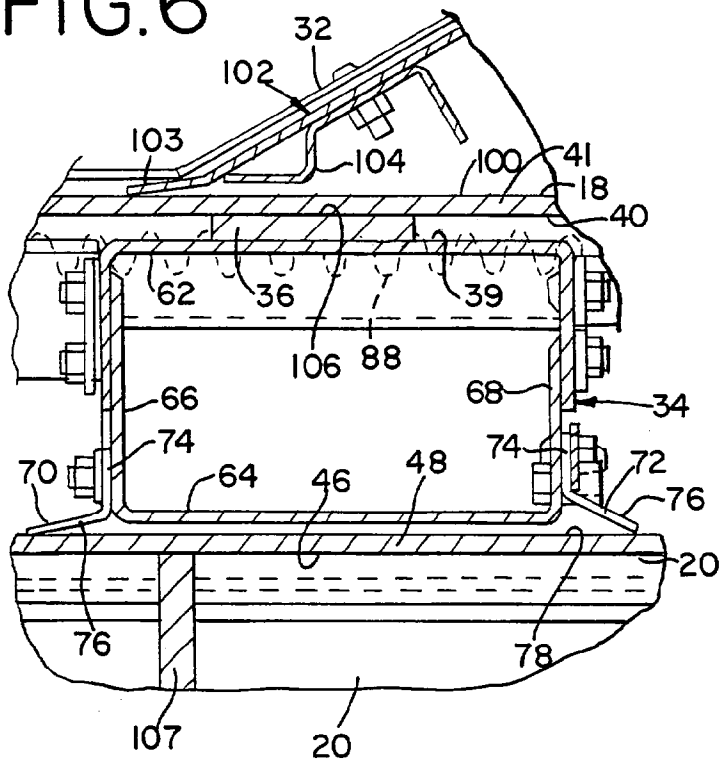
FIG. 6 is an enlarged cross-sectional view of the front portion of one embodiment of the present invention.

In the illustrated embodiment, the lower front frame assembly 34 comprises an upper channel member 62 and a lower channel member 64, shown in FIG. 6. The top surface of the upper channel member 62 is the surface 39 that supports one length of the upper slide 36. As shown in FIG. 6, the lower channel member 64 has a middle vertical leg 66 and a front vertical leg 68. The middle vertical leg 66 is connected through bolts and nuts to a middle seal element 70 and the front vertical leg 68 is connected through bolts and nuts to a front seal element 72. As shown in FIG. 6, each seal element 70, 72 includes a vertical leg 74 and an angled leg 76. The angled legs 76 contact the top surface 78 of the plate 48 of the lower gate assembly 20. The middle seal element 70 is between the front seal element 72 and a rear seal assembly 80.

The rear seal assembly 80, shown in FIG. 8, is mounted to the vertical bottom section 58 of the rear frame member 28. The rear seal assembly 80 is positioned longitudinally between the vertical bottom section 58 of the rear frame member 28 and the connecting member 54. The rear seal assembly 80 includes a rear flexible seal member 82 and a second seal member 84. The rear flexible seal member 82 and second seal member 84 both bear against the top surface 78 of the plate 48 of the lower gate assembly 20. The rear flexible seal member 82 may comprise an elastomer material such as natural or synthetic rubber. As described below, the rear second seal member 84 may comprise an ultra high molecular weight plastic such as ultra high molecular weight polyethylene.

Figure 7:
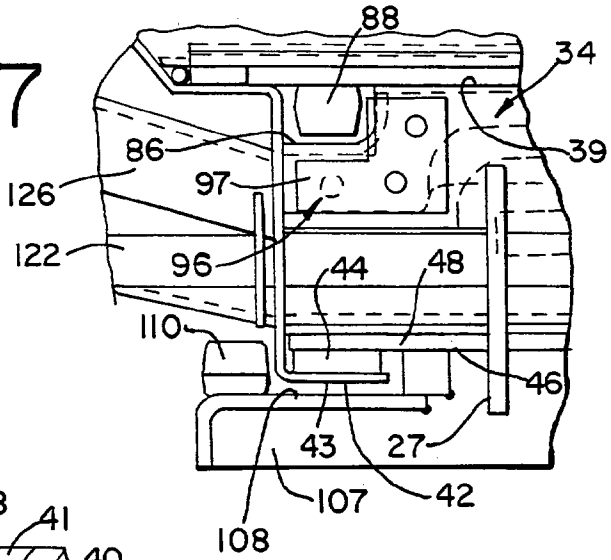
FIG. 7 is an enlarged view of a portion of the front elevation of the outlet gate assembly of FIG. 1, showing part of a seal assembly for the openings for the upper racks.

As shown in FIGS. 4–5 and 7, the upper channel member 62 of the lower front frame assembly 34 includes a pair of spaced longitudinal depressions or slots 86. The longitudinal depressions 86 correspond generally with a pair of upper longitudinal racks 88 that are attached to the bottom surface 40 of the top gate 18. The upper racks 88 may move through the slots 86 in the front frame assembly 34 as the upper gate is opened and closed.

The teeth of the upper longitudinal racks 88 engage corresponding teeth in an upper pinion gear 90. The upper pinion gear 90 is carried on an upper shaft 92 that is square in cross-section. The upper shaft 92 extends transversely through bearings in the side frame members 30 and beyond the side frame members 30 to upper capstans 94. Rotation of the upper capstans 94 causes the upper shaft 92 and upper pinions 90 to rotate to open and close the upper gate 18. The upper racks 88, upper pinion gear 90, upper shaft 92 and upper capstans 94 comprise the upper gate opening and closing drive 22.

As the upper gate 18 is opened and closed, the longitudinal upper racks 88 move longitudinally through the slots 86 in the upper channel member 62 of the lower front frame assembly 34. To seal the opening formed by these slots or depressions 86, the upper channel member 62 may carry two pair of rack seal assemblies 95, 96 as shown in FIGS. 6–7. The front rack seal assemblies 96 may include seal mounting brackets 97 that carry rack seals (not shown) through which the upper racks 88 extend. The seal mounting brackets 97 may also be shaped to serve as mounting brackets for the upper pinion 90. The middle rack seal assemblies 95 are mounted on the inward leg of the upper channel member 62, and are generally aligned with the front rack seal assemblies. The middle rack seal assemblies 95 include mounting brackets 99 and middle rack seals (not shown). The front and middle rack seals 98, 99 may comprise brushes as disclosed in U.S. patent application Ser. No. 09/166,675, filed on Oct. 5, 1998 and entitled "Railway Car Outlet Gate Assembly", but preferably comprise braided rubber. The transverse dimensions of the front and middle rack seal assemblies are great enough to cover the transverse dimensions of the slots 86. The seal elements are preferably high enough to extend to from the bottoms of the slots to the bottom surface 40 of the upper gate plate 40. Thus, the upper racks 88 must travel through both seals 95, 96 as the upper gate is opened and closed so that the outlet gate cavity 117 is protected from contamination entering with the upper racks 88.

As shown in FIG. 6, the top surface 100 of the plate 41 of the upper gate 18 is sealed by a top transverse seal assembly 102. The top transverse seal assembly 102 comprises a top seal element 103 and a metal mounting member 104. The metal mounting member 104 fixes the top seal element 103 to an angled surface of the front frame member 32. The top mounting member 104 is shaped to maintain the shape and orientation of the seal element against the top surface 100 of the plate 41. The top transverse seal assembly 102 extends across the transverse dimension of the plate 41.

As shown in FIG. 6, a transverse surface 106 of the slide 36 seals against the bottom surface 40 of the upper gate 18. The transverse surface portion 106 of the slide 36 has an expanded width and is supported by the top surface 39 of the lower front frame assembly 34.

The lower gate assembly 20 includes a plurality of transverse members 107 that are connected to the bottom surface 46 of the plate 48 of the lower gate assembly 20. As shown in FIGS. 4–5, each transverse member 107 includes a ledge portion 108 that extends laterally beyond at least part of each side frame member 30. The ledge portions 108 along one side frame member 30 have co-planar horizontal support surfaces that carry one lower rack 110. The ledge portions along the opposite side frame member 30 also have co-planar horizontal support surfaces that carry a second lower rack 112. The two lower racks 110, 112 extend longitudinally along the side frame members 30. The lower racks 110, 112 have teeth and are driven by a lower pinion gear 114. The lower pinion gear 114 is carried on a lower shaft 116 that is square in cross-section. The lower shaft 116 extends transversely through bearings in the side frame members 30 and beyond the side frame members 30 to lower capstans 118. Rotation of the lower capstans 118 causes the lower shaft 116 and lower pinion gear 114 to rotate to open and close the lower gate assembly 20.

It should be noted that the lower racks 110, 112 never enter the gate cavity 117, that is, the portion of the outlet gate assembly 10 through which lading travels. The gate cavity 117 is between the upper and lower gate assemblies 18, 20. The lower racks are outside of the gate cavity 117 throughout their range of motion. This open rack design of the lower gate assembly minimizes contamination. Accordingly, there is no need to provide any sealing in the area of the lower racks.

As shown in FIGS. 1 and 4–5, the outlet gate assembly 10 may have an angle member 120 above the upper gate 18 and meeting in a peak. The angle member 120 divides the discharge chute 14 into two longitudinal chutes 119, 121 shown in FIG. 1. Two plates may also be used to define the angle member 120.

The upper and lower gate latch mechanisms 26, 27 may be connected to standard operating rods 122, 124 for manual opening of the latch mechanisms. As described above, the upper and lower gate latch mechanism preferably provide for automatic locking.

Each nozzle assembly 16 may include a vacuum nozzle 126 extending from opposite sides of the frame 12 and an exterior cover 128 chained to the vacuum nozzle 126. Each vacuum nozzle joins the interior gate cavity through a vacuum inlet opening 130 in one side frame member 30. The two nozzles are opposed to each other. As illustrated in FIG. 2, the discharge chute 14 has a central transverse plane 132 that intersects and is perpendicular to the upper and lower racks 88, 110, 112. Each nozzle joins the gate cavity 117 at a position forward of the transverse center plane 132. In the illustrated embodiment, each nozzle opening 130 is generally rectangular and is aligned with the transverse member 34. The transverse member 34 may have a plurality of openings 133 as shown in FIGS. 4–5 so that lading may be drawn into the interior of transverse member 34, through the openings 130 and into the vacuum nozzles. There are no nozzle baffles; the relocation of the nozzles to this longitudinally offset position eliminates the need for baffles. With no nozzle baffles, the lading will flow more easily during gravity and vacuum unloads.

The components of the frame 12 may be made of cast or forged steel, stainless or carbon steel, cast iron or any other conventional material. The seals 70, 72, 72A, 84, and 103 may all be made of polymer materials, and are preferably made of an ultra high molecular weight polymer such as polyethylene that is FDA-approved for use with food products. The slides 36, 44 are preferably made of an ultra high molecular weight polymer such as polyethylene or of other material that reduces friction as the gates are opened and closed. The transverse flange cover 52 and shim 50 may be made of metal such as stainless steel, for example. It should be understood that these materials are identified for purposes of illustration only, and that the invention is not limited to any particular type of material unless expressly set forth in the claims. The other components may be made of metal such as stainless steel, carbon steel, iron or any other conventional material.

During transport of the hopper car, both the upper gate 18 and the lower gate assembly 20 are fully closed as shown in FIGS. 1–2. The seals 70, 72, 82, 84, 103 engage the upper and lower surfaces 100, 40 of the plate 41 of the upper gate assembly 18 and the upper surface 78 of the plate 48 of the lower gate assembly 20 to prevent contaminants from entering the gate cavity 117. The two gate latch mechanisms 26, 27 keep the two gates closed during transport.

During transport, the laterally-extending edge portions 108 of the lower gate 20 cover and protect the horizontal bottom ledges 42 and elongate strip slides 44 from excessive contamination to minimize any cleaning that may be necessary before discharge through the lower discharge opening 21. The laterally-extending edge portions 108 cover the downward-facing surfaces 43 of the ledges 42 when the lower gate 20 is closed. The bottom surface 46 of the lower plate 48 covers and protects the top surfaces of the slides 44. The longitudinal extension provided by the horizontal transverse plate 52 protects the downward-facing surface of frame leg 55 from contamination. The lower plate 48 covers the bottom side of the lower channel member 64 of transverse frame element 34 to protect it from contamination. Thus, the bottom surfaces are protected in the present invention without the need for a separate mud plate.

To discharge lading through the outlet gate assembly by means of a vacuum system, a worker disengages the top latch mechanism 26. The upper gate 18 may then be opened from either side of the railway car by rotating one of the upper capstans 94 in an opening direction. The upper capstan 94 may be rotated by a power drive or by a pry bar. Opening rotation of the upper capstan 94 rotates the upper shaft 92. Rotation of the upper shaft 92 causes the upper pinion gear or gears 90 to rotate. The meshed teeth of the pinion gear or gears 90 and upper rack or racks 88 cause the upper racks to move longitudinally in a forward direction. As the racks 88 move longitudinally in a forward direction, so does the plate 41 of the upper gate assembly, and an upper discharge opening 19 is thereby provided between the railway car hopper and the gate cavity 117, as shown in FIG. 9. The lading may then fall into the gate cavity 117; downward movement is limited by the lower gate assembly 20. The exterior covers 128 of the vacuum nozzle assemblies 16 may be removed and vacuum hoses may be attached to the vacuum nozzles 126. The lading may then be drawn into the interior of the front frame assembly 34 through holes 133, and then through the openings 130 in the side walls 30, into the vacuum nozzles 126 and out the vacuum hoses.

To discharge lading through the outlet gate assembly 18 by either the gravity or pneumatic sled discharge, the upper gate assembly is opened as described in the preceding paragraph. The lower gate assembly 20 is also opened. The lower gate may be opened from either side of the railway car by rotating one of the lower capstans 118. The lower capstans 118 may be rotated by a power drive or by a pry bar. Opening rotation of the lower capstan 118 rotates the lower shaft 116. Rotation of the lower shaft 118 causes the lower pinion 114 to rotate. The meshed teeth of the lower pinion gear or gears 114 and lower racks 110, 112 cause the lower racks 110, 112 to move longitudinally in a forward direction. As the racks 110, 112 move longitudinally forward, so does the lower plate 48, and a lower discharge opening 21 is thereby provided below the gate cavity 117. The lower gate 20 may be opened as shown in FIG. 10, although it may be desirable to further open the gate so that the extension or cover 52 of the lower gate assembly does not interfere with the movement of lading. In either case, the lower plate 48 generally covers the bottom surface of the bottom channel 64 of the transverse frame element 34 throughout the entire range of motion of the lower gate assembly 20. When the lower gate plate 48 is moved out of the way, the lading may fall past the gate cavity 117.

After discharge is complete, the gates 18, 20 can be closed by reversing operation of the capstans 94, 116. As the upper plate 41 and upper racks 88 move longitudinally rearward, the seal element 103 protects the cavity 117 from contaminants entering along the top surface 110 of the upper plate 41, slide 36 protects the cavity 117 from contaminants entering along the bottom surface 40 of the upper plate 41, and seal assemblies 96 protect the cavity 117 from contaminants entering with the upper racks 88. As the lower plate 48 and lower racks 110, 112 move longitudinally rearward, the seal elements 70, 72, **72*a* protect the cavity 117 from contaminants entering along the top surface 78 of the lower gate 48. After the upper plate and lower plate have moved a sufficient distance, the latches 26, 27** automatically rotate into the locked position.

The outlet gate assembly of the present invention can also be used with a pneumatic sled discharge. As described above, the design of the lower gate assembly 20 protects the surfaces that will be contacted by the pneumatic sled assembly so that it should not be necessary to clean these surfaces in a separate step.

It should be understood that other structures could be incorporated into the design. For example, an interlocking mechanism could be provided so that the upper and lower gates can be selectively opened and closed as a unit.

The independent movement of the upper and lower gates allows for inspection of the upper gate and the gate cavity while the railcar is loaded with lading.

While only specific embodiments of the invention have been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

I claim:

1. An outlet gate assembly adapted to be mounted on a hopper container, said assembly comprising:

a frame defining a generally rectangular discharge opening, said frame having a pair of frame side members and a transverse member extending between the side members;

an upper gate assembly mounted on the frame, the upper gate assembly including an upper plate having top and bottom surfaces;

a lower gate assembly mounted on the frame, the lower gate assembly including a lower plate having top and bottom surfaces;

said upper plate being movable in a longitudinal direction between open and closed positions;

said lower plate being movable in a longitudinal direction between open and closed positions;

wherein the outlet gate assembly has a cavity below the bottom surface of the upper plate of the upper gate assembly and above at least part of the top surface of the lower gate assembly when the upper and lower plates are in the closed positions;

a seal between the transverse member of the frame and the bottom surface of the upper plate, said seal extending transversely across at least part of the upper plate;

an ultra high molecular weight seal between the transverse member of the frame and the top surface of the lower plate, said seal extending transversely across at least part of the lower plate;

an ultra high molecular weight seal between another portion of the frame and the top surface of the lower plate, said seal extending transversely across at least part of the lower plate.

2. The outlet gate assembly of claim 1 further comprising a second ultra high molecular weight seal between the transverse member of the frame and the top surface of the lower plate, said second seal extending transversely across at least part of the lower plate.

3. The outlet gate assembly of claim 1 wherein the ultra high molecular weight seal is made from a material suitable for use with food service.

4. An outlet gate assembly adapted to be mounted on a hopper container, said assembly comprising:

a frame defining a generally rectangular discharge opening, said frame having a pair of frame side members and a rear frame member;

an upper gate assembly mounted on the frame and movable longitudinally between open and closed positions, the upper gate assembly including an upper plate with a top surface and a bottom surface;

a lower gate assembly mounted on the frame and movable longitudinally between open and closed positions, the lower gate assembly including a lower plate with a top surface and a bottom surface;

wherein the outlet gate assembly has a cavity below the bottom surface of the upper plate of the upper gate assembly and above at least part of the top surface of the lower plate of the lower gate assembly when the upper and lower plates are in the closed positions;

each frame side member having a downward-facing longitudinal horizontal surface below the cavity that is exposed when the upper gate assembly and lower gate assembly are in the open position, said longitudinal horizontal surface being covered by a portion of said lower gate assembly when the lower gate assembly is in the closed position;

said outlet gate assembly including one downward-facing horizontal transverse surface below the cavity that is exposed when the upper gate assembly and the lower gate assembly are in the open position and covered by a portion of the lower gate assembly when the lower gate assembly is in the closed position.

* * * * *